US005606327A

United States Patent [19]

Elliott et al.

[11] Patent Number: 5,606,327

[45] Date of Patent: Feb. 25, 1997

[54] ELECTRICAL ANTENNA ASSEMBLY AND ELECTRICAL DEVICE INCLUDING SAME

[76] Inventors: Michael Elliott, P.O.B. 3; Matti Martiskainen, P.O.B. 44, both of Poriya Illit 15208, Israel

[21] Appl. No.: 485,992

[22] Filed: Jun. 7, 1995

[30] Foreign Application Priority Data

Jun. 13, 1994 [IL] Israel ..... 110008

[51] Int. Cl.[6] ..... H01Q 1/24; H01Q 1/36

[52] U.S. Cl. ..... 343/702; 343/895

[58] Field of Search ..... 343/702, 895, 343/749, 901, 900, 715; H01Q 1/24, 1/36

[56] References Cited

U.S. PATENT DOCUMENTS 4,170,014 10/1979 Sully ..... 343/749
5,204,687 4/1993 Elliott et al. ..... 343/702
5,343,213 8/1994 Kottke et al. ..... 343/702

FOREIGN PATENT DOCUMENTS 467822 1/1992 European Pat. Off. .
634806A1 1/1995 European Pat. Off. ..... H01Q 1/24
6-85519 3/1994 Japan ..... H01Q 1/24
92/16980 10/1992 WIPO .

*Primary Examiner*—Hoanganh T. Le
*Attorney, Agent, or Firm*—Ladas & Parry

[57] ABSTRACT

An electrical antenna assembly includes a rod antenna, and a coil antenna carried by one end of the rod antenna. The coil antenna has a dielectric core carried by the rod antenna and preformed with a helical recess, an electrically-conductive helical coil seated in the recess, an electrical connector connected to one end of the helical coil by a crimped solderless connection, and a dielectric sleeve enclosing the helical coil.

17 Claims, 4 Drawing Sheets

ELECTRICAL ANTENNA ASSEMBLY AND ELECTRICAL DEVICE INCLUDING SAME

FIELD AND BACKGROUND OF THE INVENTION

The present invention relates to an electrical antenna assembly, and also to an electrical device including such an antenna assembly. The invention is particularly useful with respect to the retractable-type antenna assembly described in our U.S. Pat. No. 5,204,687, and is therefore described below with respect to this application.

Our prior U.S. Pat. No. 5,204,687 discloses an electrical antenna assembly particularly useful in a CT2 cordless telephone, including a rod antenna and a coil antenna carried by one end of the rod antenna. The whole antenna assembly is movable within a housing to either a retracted position within the housing wherein substantially only the coil antenna is disposed externally of the housing, or to an extended position wherein substantially the complete rod antenna and coil antenna are disposed externally of the housing. Both the rod antenna and coil antenna are pretuned to the same frequency, the arrangement being such that in the retracted position of the antenna assembly the coil antenna is enabled for use in short range operation, and in the extended position of the antenna assembly the rod antenna is enabled for use in long range operation. In the preferred embodiment described in that patent, the coil antenna and the rod antenna are both of quarter wavelength.

OBJECTS AND SUMMARY OF THE INVENTION

An object of the present invention is to provide an electrical antenna assembly of the foregoing rod/coil type but having a number of advantages as will be described more particularly below.

According to one aspect of the present invention, there is provided an electrical antenna assembly comprising: a rod antenna, and a coil antenna carried by one end of the rod antenna; characterized in that the coil antenna includes a dielectric core carried by one end of the rod antenna and preformed with a helical recess, an electrically-conductive helical coil seated in the recess, an electrical connector connected to one end of the helical coil, and a dielectric sleeve enclosing the helical coil and in that the antenna assembly further comprises a dielectric coupling member formed at one end with a cavity receiving the upper end of the rod antenna and secured at its opposite end to the coil antenna, for electrically insulating the coil antenna from the rod antenna.

According to further features in the described preferred embodiment, the electrical connector includes a metal sleeve at one end formed with a helical recess for receiving the respective end of the helical coil, and a metal stem at the opposite end for electrically connecting the helical coil to an electrical circuit. The electrical coil is connected to the electrical connector by a crimped solderless connection. In addition, the sleeve enclosing the helical coil includes a flat end which abuts against an annular shoulder at the respective end face of the preformed dielectric core.

The foregoing features provide a very sturdy construction enabling the antenna assembly, particularly the coil antenna, to retain its critical electrical radiation characteristics even when subjected to harsh mechanical treatment.

According to another aspect of the invention, the rod antenna and the coil antenna, instead of being one-quarter wavelength as in the preferred embodiment described in U.S. Pat. No. 5,204,687, are both of three-eighths wavelength. This increases the gain of the antenna. In addition, the electrical circuitry includes a common impedance matching circuit comprising an inductance of about 8.2 nH and a capacitance of about 1.4 pF connected to the rod antenna when electrically connected to the circuitry, and connected to the coil antenna when electrically connected to the circuitry. It was unexpectedly found that such an impedance matching circuit could be used for both the rod antenna and the coil antenna, and thereby obviates the need for providing two separate impedance matching circuits.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
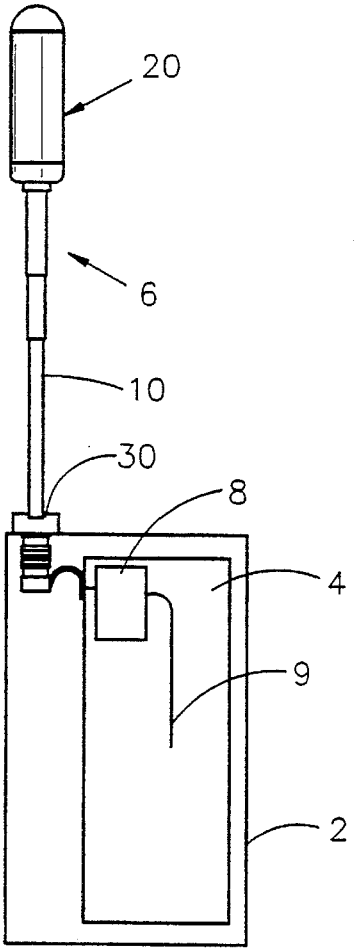
FIGS. 1 and 2 illustrate one form of electrical device including an antenna assembly constructed in accordance with the present invention, the antenna assembly being shown in its extended position in FIG. 1 and in its retracted position in FIG. 2.
Figure 2:
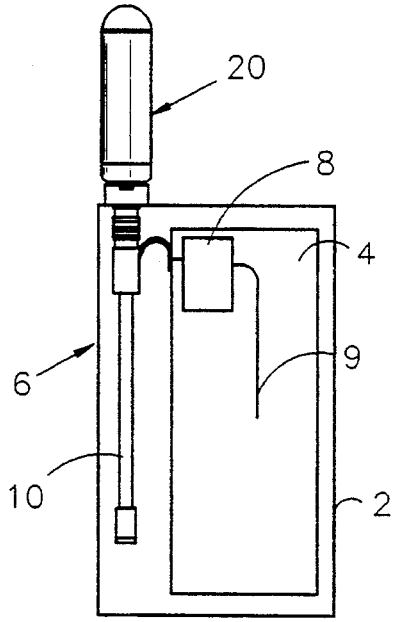

The electrical device illustrated in FIGS. 1 and 2 is an electrical transmitter-receiver unit particularly useful in a wireless radio communication system. The electrical device includes a housing 2 enclosing radio circuitry schematically indicated at 4 of the telephone transmitter-receiver, and a retractible antenna assembly, generally designated 6, which in its extended position (FIG. 1) is adapted for long-range use, and in its retracted position (FIG. 2), is adapted for short-range use. Antenna assembly 6 is connected to the radio circuitry 4 by means of an impedance matching circuit 8 and a feed line 9.

Antenna assembly 6 comprises a straight rod antenna 10 and a coil antenna 20 carried at the upper end of the rod antenna. The antenna assembly is slidable within an electrical connector 30 fixed to housing 2 and electrically connected via matching circuit 8 and feed line 9 to the radio circuitry 4, such that when the antenna assembly is in its extended position (FIG. 1) electrical connection is made from the radio circuitry 4 to the rod antenna 10, and when the antenna is in its retracted position (FIG. 2), electrical connection is made from the radio circuitry to the coil antenna 20.

FIGS. 3–7 more particularly illustrate the construction of the rod antenna 10 and the coil antenna 20 in antenna assembly 6.

Thus, the rod antenna 10 includes a central metal rod 11 and an outer dielectric sleeve 12. The lower end of the rod antenna 10 includes a metal sleeve 13 electrically connected to the central metal rod 11 and externally exposed to provide an electrical connection to the central metal rod 11. The upper end of rod antenna 10 includes a dielectric coupling member 14 coupling the upper end of the metal rod 11 and its dielectric sleeve 12 to the coil antenna 20 while at the same time interrupting electrical continuity thereto to electrically insulate the coil antenna 20 from the rod antenna 10. For this purpose, the upper end of dielectric coupling member 14 is formed with an externally-threaded dielectric stem 15 (FIGS. 6, 7) for receiving the coil antenna 20.

Figure 4:
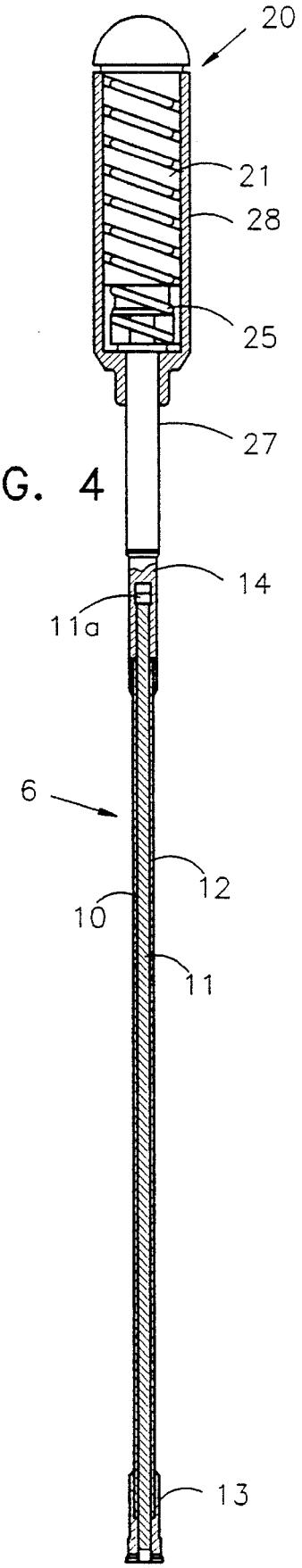
FIG. 4 is a view corresponding to that of FIG. 3, but more particularly illustrating various elements of the antenna assembly in longitudinal section.
Figure 5:
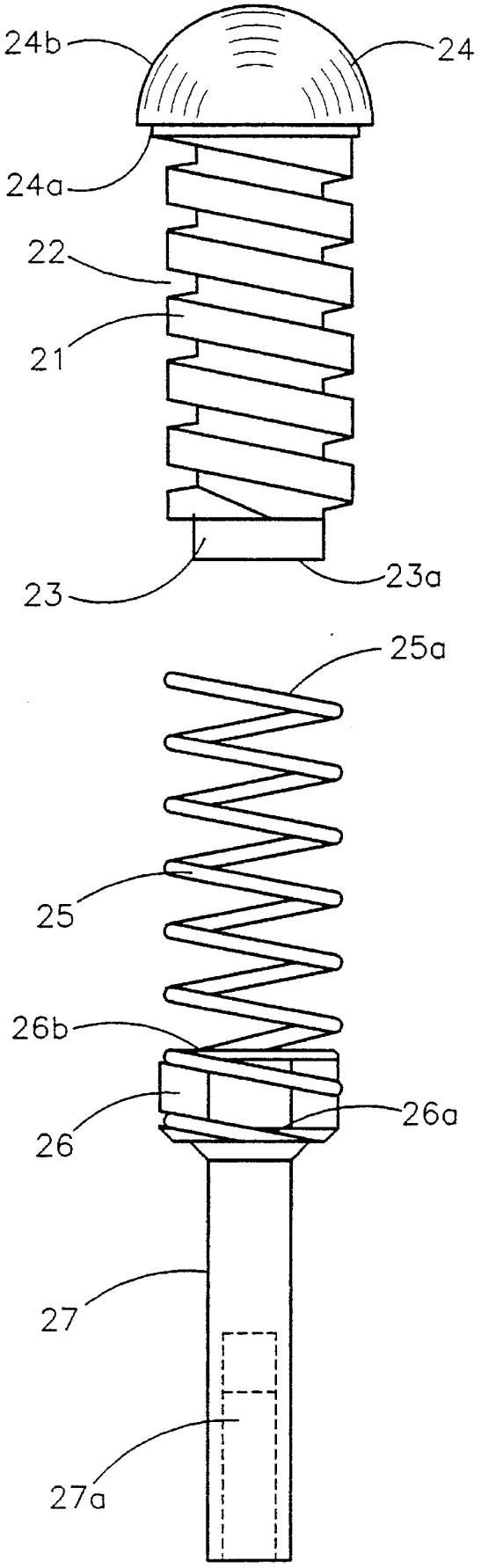
FIG. 5 is an exploded view illustrating the construction of the coil antenna in the antenna assembly of FIGS. 1–4.

The structure of the coil antenna 20 is more particularly seen in FIGS. 4 and 5. It includes a dielectric core 21 preformed with a helical recess 22 extending for its complete length except for an end section 23 of reduced diameter at one end, and an enlarged head 24 at the opposite end. The enlarged head 24 is formed with an annular shoulder **24*a* at the juncture with the helically-recessed section 21, and with a semi-spherical outer face 24*b***.

Coil antenna 20 further includes a helical coil 25 of electrically-conductive (metal) wire received within helical recess 22 of the dielectric core 21. One end **25*a* of coil 25 bears against the annular shoulder 24*a* of the core enlarged head 24. The opposite end 25*b* of coil 25 is received within a helical recess 26*a* formed in a metal connector 26. One end of metal connector 26 includes a flat end face 26*b* which abuts against the end section 23 of core 21 in the assembled condition of the coil antenna 20, the end face 23*a* of the end section 23 being flattened for this purpose. The opposite end of connector 26 includes a metal stem 27 formed with an internally-threaded bore 27*a* for receiving the externally-threaded dielectric stem 15 (FIGS. 6, 7) of the dielectric coupling member 14**.

A dielectric sleeve 28 encloses the core 21, the wire coil 25, and electrical connector 26, leaving the metal stem 27 exposed.

Electrical connector 30 is formed with a threaded body 31 (FIG. 7) for threadedly applying the connector into an opening formed in housing 2. Electrical connector 30 is engageable with metal sleeve 13 formed at the end of the rod antenna 10 in the extended position (FIG. 1) of the antenna, and with the metal stem 27 in the retracted position (FIG. 2) of the antenna. Thus, when the antenna assembly is in its extended position (FIG. 1), the electrical connection between connector 30 and metal sleeve 13 electrically connects the rod antenna 10 to the radio circuitry 4; and when the antenna assembly is in its retracted position (FIG. 2), metal sleeve 30 engaging sleeve 27 electrically connects the coil antenna 20 to the radio circuitry 4.

Figure 6:
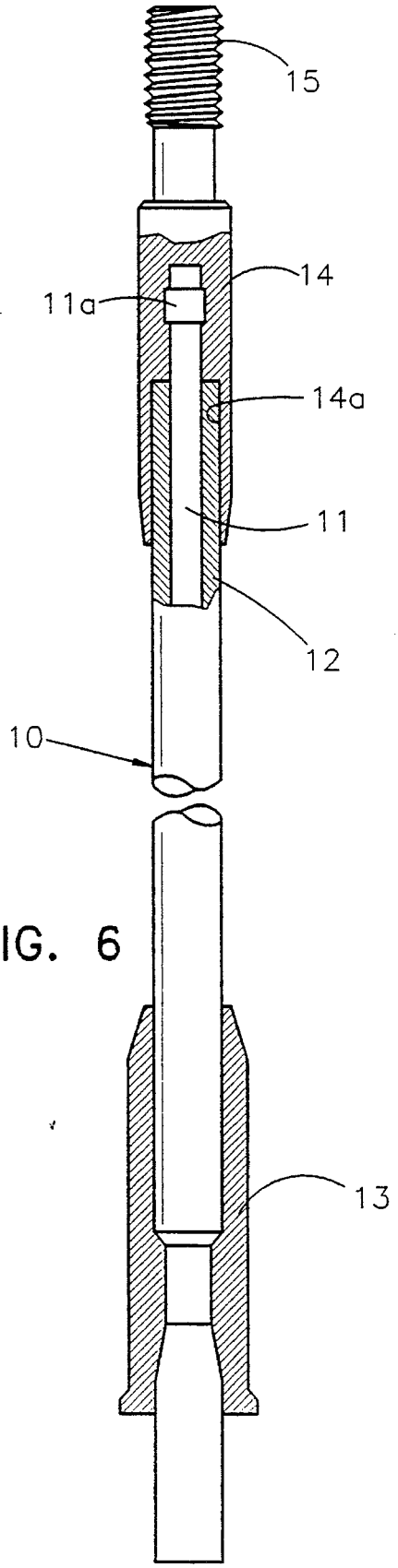
FIGS. 6 and 7 are enlarged fragmentary views, partly in section, more particularly illustrating the construction of the rod antenna in the antenna assembly of FIGS. 1–4.
Figure 7:
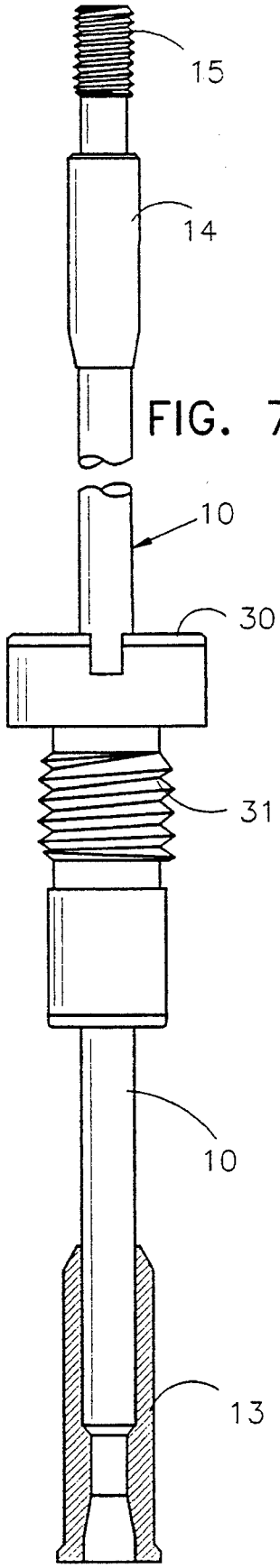

Following is one manner of constructing the antenna 6 illustrated in the drawings:

The dielectric coupling member 14 is applied, as by injection molding, to one end of the central metal rod 11 of the rod antenna 10 to cover the upper end of the metal rod 11 and also to define an externally-threaded stem 15 (FIGS. 6, 7). In order to more firmly fix the central rod 11 within the dielectric coupling member 14, the upper end of the metal rod is preferably flattened, as shown at **11*a* in FIG. 6. The lower end of the dielectric coupling member 14 is formed with a central cavity as shown at 14*a*, for receiving the upper end of the preformed dielectric sleeve 12. The latter sleeve is of a length to completely cover the central metal rod 11**.

Metal sleeve 13 is then applied over the lower end of the central metal rod 11 and the outer dielectric sleeve 12. To establish good electrical contact between metal sleeve 13 and the central rod 11, the metal sleeve is preferably forced inwardly of the outer end of the metal rod 11 and the dielectric sleeve 12; the outer tip of the metal rod is then flattened as shown at **11*b*; and the metal sleeve 13** is then forced outwardly of the metal rod and dielectric sleeve so that the flattened end of the metal rod wedges firmly against the inner surface of the metal sleeve.

The coil antenna 20 is then assembled by applying the helical wire 25 in the helical recess 22 of the preformed core 21 until end **25*a* of the wire abuts against shoulder 24*a* of the thickened end 24 of the core. The opposite end 25*b* of the helical wire 25 is threaded into helical recess 26*b* of metal connector 26 until the flat face 26*b* of the metal connector abuts against the flat face 23*a* of the core. End 25*b* of helical wire 25 is then crimped onto the metal connector 26 to provide a good electrical contact. This electrical contact is preferably solderless because solder tends to wick and thereby to change the electrical characteristics of the coil 25**.

Dielectric sleeve 28 is then applied to abut the flat annular wall **24*a* of the thickened head 24 and to cover the complete metal coil 25 and electrical connector 26 at the opposite end of the coil, but to leave exposed substantially the full length of the metal stem 27. If desired, a glue may be applied over the outer surface of core 21 and its coil 25 to produce a strong mechanical bond between the dielectric sleeve 28, core 21, metal coil 25 and electrical connector 26**.

When the antenna has thus been assembled, it may then be inserted through connector 30 fixed by its threaded body 31 to housing 2. Thus, antenna assembly 6 may then be moved to its extended position (FIG. 1), whereupon connector 30 engages metal sleeve 13 to electrically connect the rod antenna 10 to the radio circuitry 4. When the antenna assembly is moved to its retracted position (FIG. 2), electrical connector 30 engages metal stem 27 to thereby connect the coil antenna 12 to the electrical circuitry. The extended position of the antenna assembly (FIG. 1) thus enables the rod antenna 10 for long range operation; whereas the retracted position (FIG. 2) of the antenna assembly enables the coil antenna 20 for short range operation.

It has been found that if the rod antenna 10 and coil antenna 20 are each of three-eighths wavelength, rather than one-quarter wavelength, the antenna gain is increased. However, this has been found to require an impedance matching circuit as shown at 8 in FIGS. 1 and 2.

Figure 8:
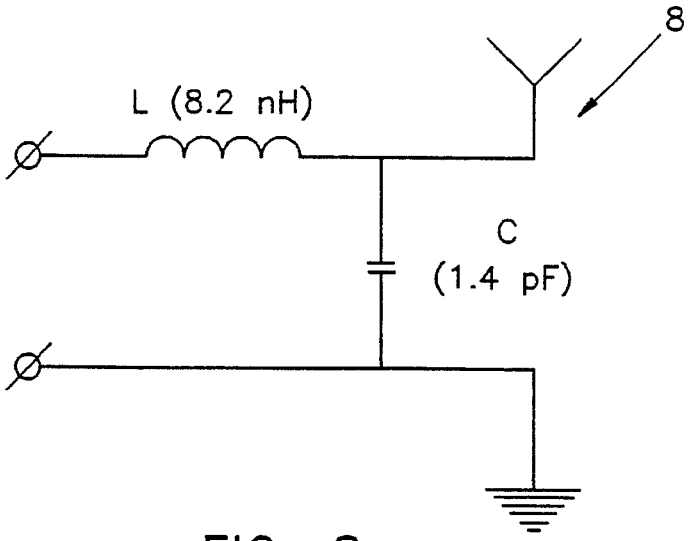
FIG. 8 illustrates the common impedance matching circuit which is used for both the rod antenna and the coil antenna.
Figure 3:
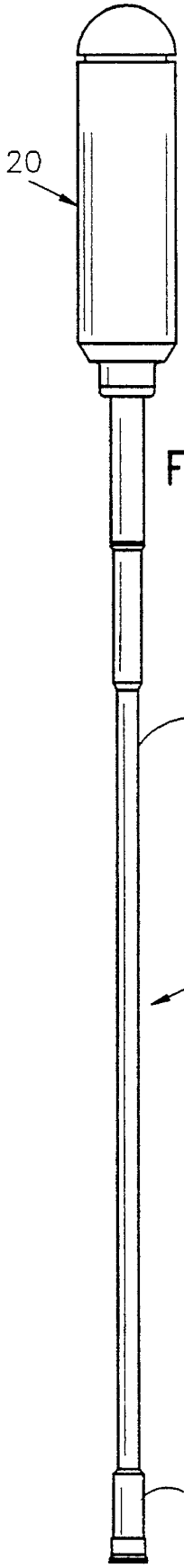
FIG. 3 is an end elevational view more particularly illustrating the antenna assembly of FIGS. 1 and 2.

FIG. 8 illustrates one impedance matching circuit which has been unexpectedly found to be usable for both the rod antenna 10 and the coil antenna 20 thereby obviating the need for a separate matching circuit for each of the two antennas when enabled. As shown in FIG. 8, the impedance matching circuit 8 includes an inductance coil L of a value of 8.2 nH, connected between the feed line 9 and the enabled rod antenna 10 or coil antenna 20, and a capacitance C of 1.4 pF, between ground and the juncture of the inductance coil L and the antenna.

While the invention has been described with respect to one preferred embodiment, it will be appreciated that this is set forth merely for purposes of example, and that many other variations, modifications and applications of the invention may be made.

We claim:

1. An electrical antenna assembly, comprising: a rod antenna having a lower end and an upper end, and a coil antenna carried by the upper end of the rod antenna; said coil antenna including a dielectric core carried by said upper end of the rod antenna and preformed with a helical recess, an electrically-conductive helical coil seated in said recess, an electrical connector connected to one end of said helical coil, a dielectric sleeve enclosing said helical coil; said antenna assembly further comprising a dielectric coupling member formed at one end with a cavity receiving said end of the rod antenna, and secured at its opposite end to said coil antenna, for electrically insulating said coil antenna from said rod antenna, said rod antenna and coil antenna each being of three-eights wavelength; and a common impedance matching circuit connectible either to the rod antenna, or to the coil antenna via said electrical connector.

2. The antenna assembly according to claim 1, wherein said electrical connector is formed at one end with a helical recess for receiving said one end of the helical coil, and includes a metal stem at the opposite end for electrically connecting the helical coil to said impedance matching circuit; said one end of the helical coil being connected to said one end of the electrical connector by a crimped solderless connection.

3. The antenna assembly according to claim 2, wherein said metal stem of the electrical connector is formed with an axial bore, and said dielectric coupling member is formed at said opposite end thereof with a stem received within said axial bore for securing said coil antenna to, but electrically insulated from, said rod antenna.

4. The antenna assembly according to claim 2, wherein said dielectric core is integrally formed with an enlarged head at its free end circumscribed by an annular shoulder, said helical recess in the core terminating at said enlarged head with the free end of the helical coil abutting said annular shoulder circumscribing said enlarged head.

5. The antenna assembly according to claim 2, wherein said lower end of the rod antenna includes an electrical connector, such that either the rod antenna may be electrically connected to said impedance matching circuit via said latter electrical connector, or the coil antenna may be electrically connected to said impedance matching circuit via said metal stem.

6. An electrical antenna assembly, comprising: a rod antenna having a lower end and an upper end, and a coil antenna carried by the upper end of the rod antenna; said coil antenna including a dielectric core carried by said upper end of the rod antenna and preformed with a helical recess, an electrically-conductive helical coil seated in said recess, an electrical connector connected to one end of said helical coil, a dielectric sleeve enclosing said helical coil; said antenna assembly further comprising a dielectric coupling member formed at one end with a cavity receiving said end of the rod antenna, and secured at its opposite end to said coil antenna, for electrically insulating said coil antenna from said rod antenna, wherein said electrical connector is formed at one end with a helical recess for receiving said one end of the helical coil and includes a metal stem at the opposite end for electrically connecting the helical coil to an electrical circuit; said one end of the helical coil being connected to said one end of the electrical connector by a crimped solderless connection; and wherein said metal stem is formed with an internally-threaded bore, and said dielectric coupling member is formed at said opposite end with an externally-threaded stem received within said internally-threaded bore for securing said coil antenna to, but electrically insulated from, said rod antenna.

7. An electrical device, comprising:

a housing enclosing electrical circuitry;

an antenna assembly according to claim 6 movable to a retracted position within the housing where substantially only the coil antenna is exposed externally of the housing, or to an extended position wherein substantially the complete rod antenna and coil antenna are exposed externality of the housing;

said electrical circuitry including said impedance matching circuit;

and an electrical connector carried by the housing and effective to electrically connect said metal stem of the coil antenna to the electrical circuitry in the retracted position of the antenna assembly, or to electrically connect said electrical connector of the rod antenna to the electrical circuitry in the extended position of the antenna assembly.

8. The electrical device according to claim 7, wherein both the rod antenna and the coil antenna are pretuned to the same frequency for short range operation and long range operation, respectively.

9. The electrical device according to claim 8, wherein said common impedance matching circuit comprises an inductance of about 8.2 nH and a capacitance of about 1.4 pF connected to the rod antenna when the rod antenna is electrically connected to said circuitry, and connected to the coil antenna when the coil antenna is electrically connected to said circuitry.

10. An electrical device, comprising:

a housing enclosing electrical circuitry; an antenna assembly including a rod antenna having a lower end and an upper end, a coil antenna carried at the upper end of the rod antenna and pretuned to the same frequency thereof, and a dielectric coupling member securing said coil antenna to the upper end of said rod antenna but electrically insulating said coil antenna from said rod antenna; said antenna assembly being movable to a retracted position within the housing where substantially only the coil antenna is exposed externally of the housing, or to an extended position wherein substantially the complete rod antenna and coil antenna are exposed externally of the housing; an electrical connector carried by the housing and effective to electrically connect said coil antenna to the electrical circuitry in the retracted position of the antenna assembly, and to electrically connect said rod antenna to the electrical circuitry in the extended position of the antenna assembly; said rod antenna and said coil antenna each being of three-eighths wavelength of said same frequency, said electrical circuitry including a common impedance matching circuit comprising an inductance of about 8.2 nH and a capacitance of about 1.4 pF connected to the rod antenna when the rod antenna is electrically connected to said circuitry, and connected to the coil antenna when the coil antenna is electrically connected to said circuitry.

11. The electrical device according to claim 10, wherein said coil antenna includes a dielectric core preformed with a helical recess, an electrically-conductive helical coil seated in said recess, an electrical connector connected to one end of said helical coil, and a dielectric sleeve enclosing said helical coil; and wherein said dielectric coupling member is formed at one end with a cavity receiving said upper end of the rod antenna, and is secured at its opposite end to said coil antenna, thereby electrically insulating said coil antenna from said rod antenna.

12. The electrical device according to claim 11, wherein said electrical connector is formed at one end with a helical recess for receiving the respective end of the helical coil, and includes a metal stem at the opposite end for electrically connecting the helical coil to the electrical circuitry.

13. The electrical device according to claim 12, wherein said electrical connector receiving an end of the helical coil includes a flat end face which abuts against the respective end face of the dielectric core.

14. The electrical device according to claim 12, wherein the helical coil received in the helical recess of said electrical connector is electrically connected to said electrical connector by a crimped, solderless connection.

15. The electrical device according to claim 12, wherein said dielectric core is preformed with an enlarged head at its free end, said helical recess in the core terminating at said enlarged head with the free end of the helical coil abutting said enlarged head.

16. The electrical device according to claim 12, wherein said metal stem is formed with an internally-threaded bore and receives an externally-threaded dielectric pin carried at the respective end of the dielectric coupling member for fixing the coil antenna to the rod antenna.

17. The electrical device according to claim 16, wherein the lower end of the rod antenna includes an electrical connector, such that either the rod antenna maybe electrically connected to said electrical circuitry via said electrical connector, or the coil antenna may be electrically connected to said electrical circuitry via said metal stem.

* * * * *

UNITED STATES PATENT AND TRADEMARK OFFICE

CERTIFICATE OF CORRECTION

PATENT NO. : 5,606,327

DATED : February 25, 1997

INVENTOR(S) : MICHAEL ELLIOTT, et al.

It is certified that error appears in the above-indentified patent and that said Letters Patent is hereby corrected as shown below:

On title page, insert -- Item [73] Assignee: Galtronics Ltd., Tiberias 14115, Israel --

Signed and Sealed this

Ninth Day of September, 1997

*Attest:*

*Attesting Officer*

BRUCE LEHMAN

*Commissioner of Patents and Trademarks*